US007193570B2

(12) United States Patent
Liu

(10) Patent No.: US 7,193,570 B2
(45) Date of Patent: Mar. 20, 2007

(54) CABLE ANTENNA ASSEMBLY HAVING SLOTS IN GROUNDING SLEEVE

(75) Inventor: Huang Hsin Liu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/000,749

(22) Filed: Nov. 30, 2004

(65) Prior Publication Data

US 2005/0128163 A1 Jun. 16, 2005

(30) Foreign Application Priority Data

Dec. 16, 2003 (TW) ..... 92222011 U

(51) Int. Cl.
*H01Q 1/24* (2006.01)
*H01Q 1/38* (2006.01)

(52) U.S. Cl. ..... 343/702; 343/700 MS; 439/916

(58) Field of Classification Search ..... 343/702, 343/718, 789, 790, 791, 872, 906; 439/98, 439/131, 165, 446, 542, 623, 916
See application file for complete search history.

(56) References Cited

U.S. PATENT DOCUMENTS 4,066,324 A * 1/1978 Stephens ..... 439/581
5,002,503 A * 3/1991 Campbell et al. ..... 439/578
5,168,280 A * 12/1992 Blaese ..... 343/715
5,293,177 A * 3/1994 Sakurai et al. ..... 343/906
5,346,403 A * 9/1994 Hyzin ..... 439/95
5,576,720 A * 11/1996 Gorenz et al. ..... 343/702
5,973,645 A 10/1999 Zigler et al. ..... 343/702
6,133,884 A * 10/2000 Talvitie et al. ..... 343/702
6,137,056 A * 10/2000 Miyazaki ..... 174/78
6,447,334 B2 * 9/2002 Togashi et al. ..... 439/578
6,518,928 B1 * 2/2003 Sheu ..... 343/702
6,710,747 B1 * 3/2004 Chang ..... 343/702
2003/0049956 A1 * 3/2003 Yoshida ..... 439/98

* cited by examiner

*Primary Examiner*—Don Wong
*Assistant Examiner*—Marie Antoinette Cabucos
(74) *Attorney, Agent, or Firm*—Wei Te Chung

(57) ABSTRACT

A cable antenna assembly (1) connecting with an electronic device via a connector (5) includes a connecting portion (4), a rotating portion (3) rotatably mounted on the connecting portion, and a cable antenna element (9) including a coaxial cable (6) including an inner conductor (62), an inner insulator, an outer conductor (61) and an outer insulator (60), and a grounding sleeve (7) surrounding the coaxial cable and inserted between an inner and an outer rings (30*a*) and (30*b*) of the rotating portion. The grounding sleeve defines a fixing hole (71) for connecting with the outer conductor of the coaxial cable and a slot (70) for making the fixing hole elastically expand when the coaxial cable is inserted and then elastically contract for securely fixing the coaxial cable.

13 Claims, 5 Drawing Sheets

CABLE ANTENNA ASSEMBLY HAVING SLOTS IN GROUNDING SLEEVE

BACKGROUND OF THE INVENTION

1. Field of the Invention

The present invention concerns generally the practical field of an antenna assembly, and especially concerns a cable antenna assembly.

2. Description of the Prior Art

Wireless connection between information appliances, such as notebook computers and mobile phones, and network systems, is becoming a modern trend for information appliances. An antenna is required for facilitating wireless connection. Since the information appliances usually have a small size, a conventional antenna occupying a great amount of space is not suitable for such an application. Thus antennas made of coaxial cables that are widely used in information appliances are prevailing. A coaxial cable antenna may comprise at least one coaxial cable having a first end connected to a signal processing circuit of the information appliance and a second end exposed for receiving/transmitting electromagnetic signals.

A cable antenna is disclosed in U.S. Pat. No. 5,973,645. A cable antenna assembly comprises a base member 68, a plug connector 70, a coaxial cable 72 extending away from the plug connector 70, and a tubular grounding portion 74. The coaxial cable 72 and the tubular grounding portion 74 corporately form an active antenna portion 78 adapted to receive and transmit selected signals at a selected frequency. In this prior art, the tubular grounding portion 74 has an end being fastened to crimp onto the coaxial cable 72 by a tool, whereby securely surrounding the coaxial cable. In other prior arts, the tubular grounding portion and the coaxial cable can also be fixed by soldering. It is clear that a crimping step by the tool or a soldering step is necessary in a manufacturing process of the cable antenna. Additionally, the quality of crimping or soldering affects receiving/transmitting effect of the cable antenna assembly. Furthermore, once crimping or soldering step is done, the fixing position of the coaxial cable and the grounding portion cannot be tuned, so as not to achieve a better receiving/transmitting effect of the cable antenna assembly by tuning the fixing position thereof.

Hence, synthetically consider the factors of manufacturing process and receiving/transmitting effect, an antenna having slots in a grounding sleeve is need in art to overcome the above-mentioned disadvantages of the conventional cable antenna.

BRIEF SUMMARY OF THE INVENTION

A primary object, therefore, of the present invention is to provide a cable antenna assembly having slots in a grounding sleeve for easily assembling a cable antenna element.

The cable antenna assembly for connecting with an electronic device via a connector comprising a connecting portion, a rotating portion being rotatably mounted on the connecting portion, and a cable antenna element comprising a coaxial cable being inserted into the connecting portion through the rotating portion and comprising an inner conductor, an inner insulator, an outer conductor and an outer insulator, and a grounding sleeve surrounding the coaxial cable and inserted between an inner ring and an outer ring in the rotating portion. The grounding sleeve defines a fixing hole for connecting with the outer conductor of the coaxial cable and a slot for making the fixing hole elastically expand when the coaxial cable is inserted and then contract for securely fixing the coaxial cable.

Other objects, advantages and novel features of the invention will become more apparent from the following detailed description when taken in conjunction with the accompanying drawings.

DETAILED DESCRIPTION OF THE INVENTION

Reference will now be made in detail to preferred embodiments of the present invention.

Figure 1:
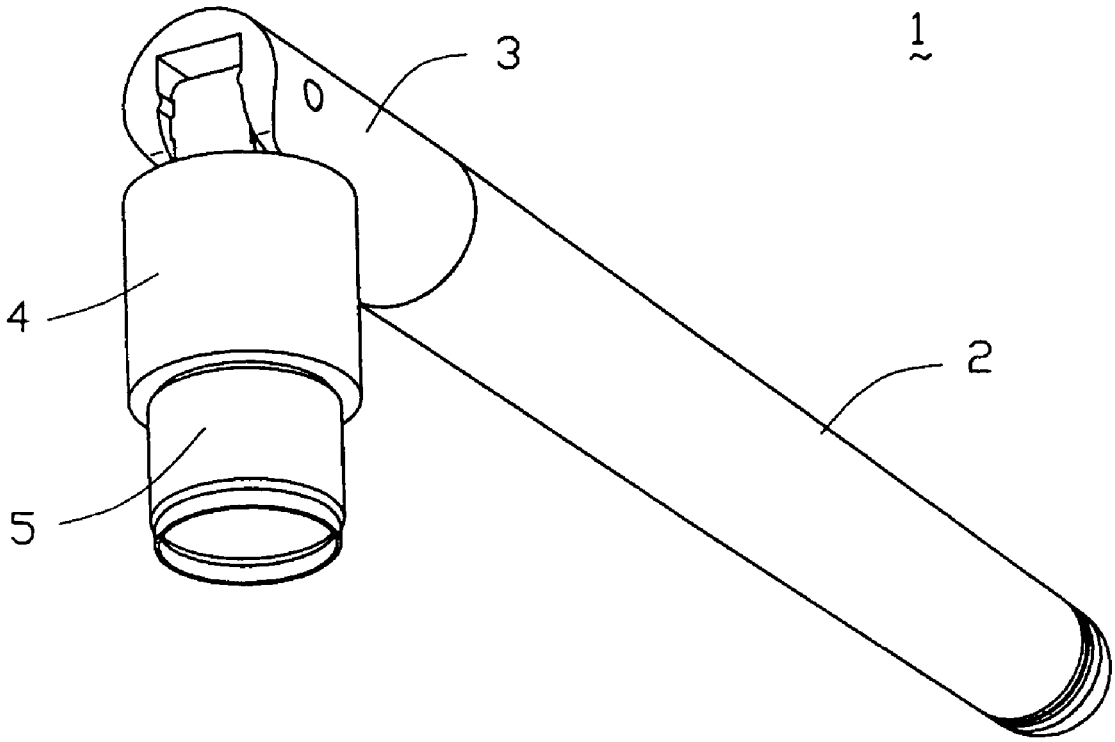
FIG. 1 is a perspective view of an cable antenna assembly according to a first embodiment of the present invention.
Figure 2:
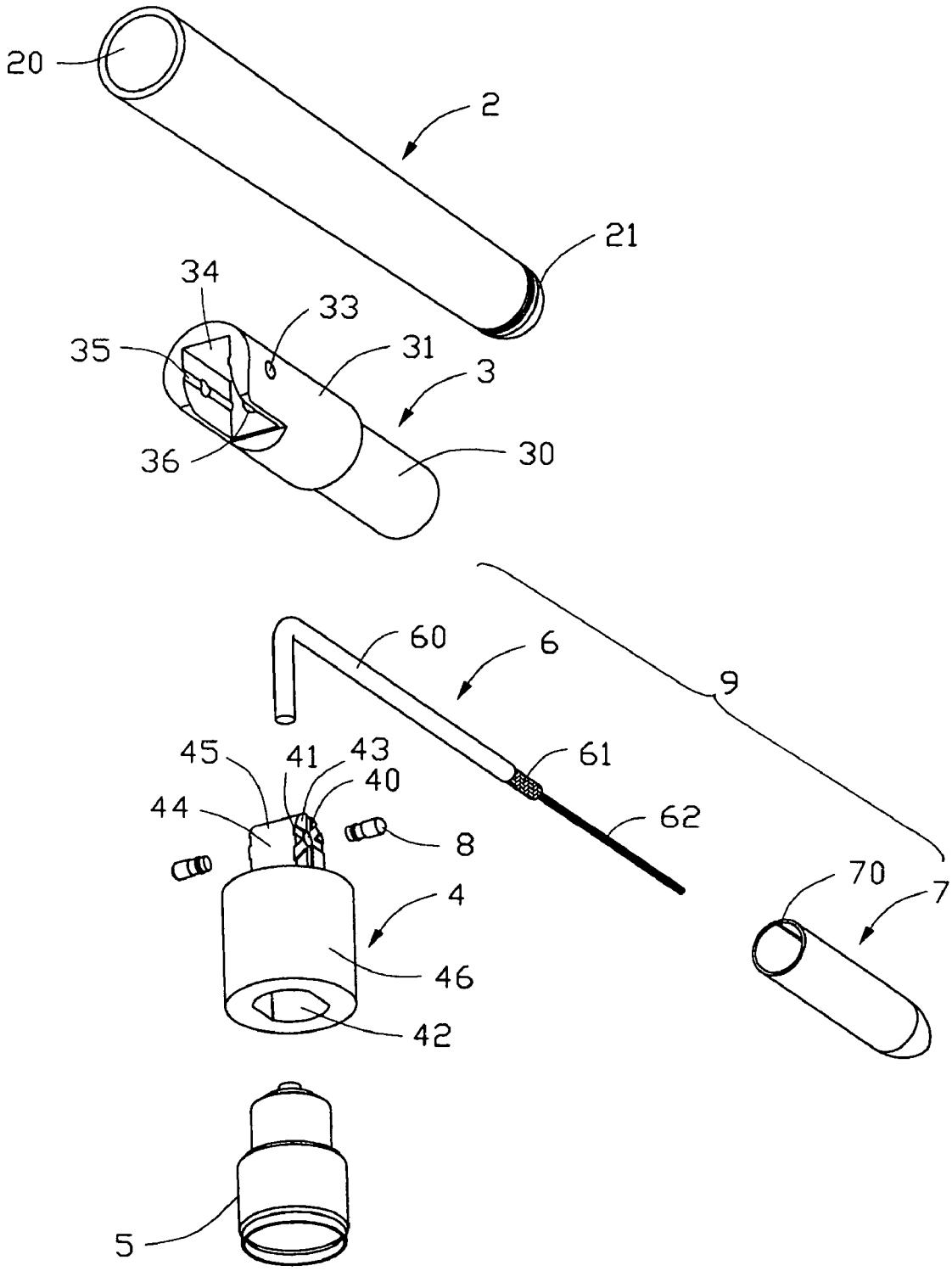
FIG. 2 is an exploded view of the cable antenna assembly of FIG. 1.
Figure 3:
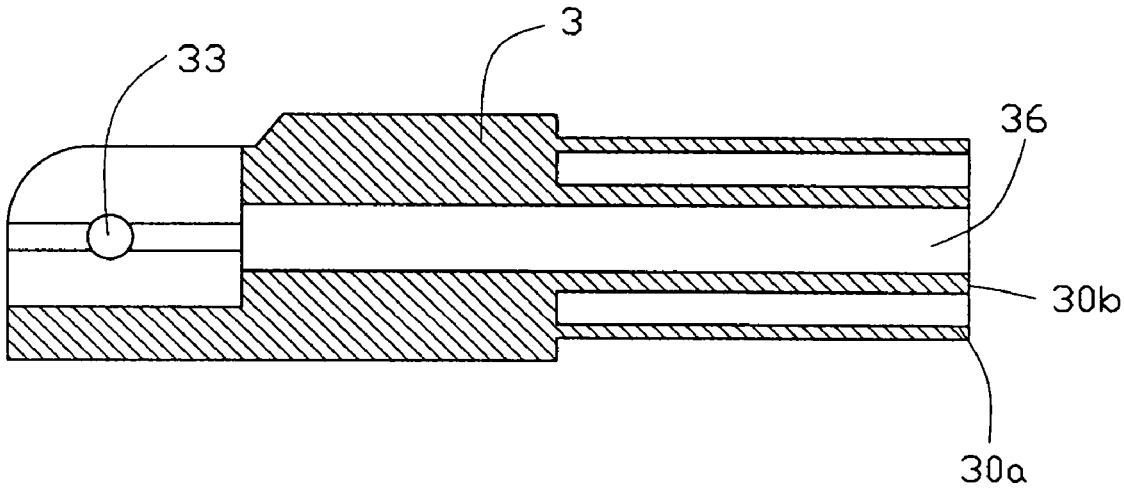
FIG. 3 is a cross-sectional view of a rotating portion of the cable antenna assembly.

Referring to FIGS. 1–3, a cable antenna assembly 1 according to a first preferred embodiment of the present invention comprises an outer sleeve 2, a rotating portion 3, a connecting portion 4, two bolts 8, and a cable antenna element 9 comprising a coaxial cable 6 and a grounding portion 7. The cable antenna assembly 1 is connecting to a corresponding connector (not shown), thereby connecting with an electronic device (not shown) via a connector 5. The connector 5 is well known to the ordinary skills in the art, so a detail description of the connector 5 is omitted here.

The outer sleeve 2 is an elongate tubular sleeve and is made of insulative material. The outer sleeve 2 has an open end 20 and a closed end 21. The outer sleeve 2 is provided for surrounding and protecting the main antenna body 9.

The connecting portion 4 is made of insulative material and is connected to the connector 5. The connecting portion 4 comprises a bottom member 46 and a top member 44 settled on the bottom member 46. The top member 44 comprises a saddle surface 45 defining a first cable through hole (not shown) corresponding to the first cable through hole of the connector 5 for holding the coaxial cable 6, and two side surfaces 43. Each side surface 43 defines an inner bolting hole 40 for allowing the bolt 8 to be inserted therein and a plurality of fixing channels 41. The bottom member 46 defines a receiving cavity 42 for engaging with the connector 5.

The cable antenna element 9 is received in the outer sleeve 2. The coaxial cable 6 is bent to form a level portion (not labeled) and a perpendicular portion (not labeled). The level portion has an exposed end (not labeled) which reveals an inner conductor 62 for transmitting/receiving electromagnetic signals and is successively surrounded by an inner insulator (not shown), an outer conductor 61, and an outer insulator 60 commonly coaxially coextensive therewith. The perpendicular portion is inserted through the first cable through hole of the connecting portion 4 into the connector 5 and is secured by the connector 5.

Figure 4:
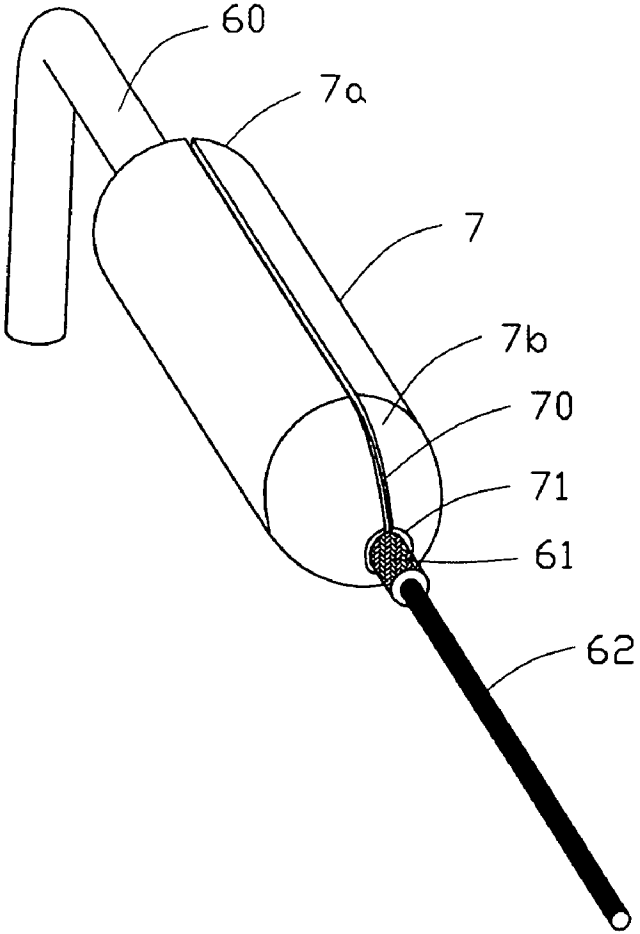
FIG. 4 is a perspective view of a main antenna body of the cable antenna assembly of FIG. 1.

As better seen in FIG. 4, the grounding sleeve 7 is a bottle-shaped metal sleeve surrounding the coaxial cable 6 and comprises a bigger open mouth 7*a* and an opposite smaller half-closed mouth 7*b*. The half-closed mouth 7*b* defines a fixing hole 71 having a little smaller diameter than that of the outer conductor 61 of the coaxial cable 6. The grounding sleeve 7 defines a long slot 70 extending from the half-closed mouth 7*b* to the open mouth 7*a* along the direction of the coaxial cable 6. On account of the long slot 70 in the grounding sleeve 7 and the resilient ability of metal, when the coaxial cable 6 is inserted, the fixing hole 71 may be elastically expanded a little to allow the outer conductor 61 of the coaxial cable 6 to be inserted therethrough and then elastically contract back to securely fix the outer conductor 61 therein.

Back to FIGS. 2 and 3, the rotating portion 3 is provided for rotating the cable antenna element 9 in different positions for a better receiving/transmitting of an electromagnetic wave. The rotating portion 3 is an elongate cylinder and defines a second cable through hole 36 for allowing the coaxial cable 6 to be inserted therethrough, whereby the coaxial cable 6 is inserted into the connecting portion 4 and the connector 5. The rotating portion 3 comprises a narrower front member 30 and a wider rear member 31. The front member 30 comprises an outer ring 30*a* and an inner ring 30*b* which are both cylindrical and are coaxial with each other. The inner ring 30*b* and the outer ring 30*a* corporately form a circle space (not labeled) for receiving the grounding sleeve 7. The rear member 31 is cylindrical and is thicker than the front member 30. The rear member 31 defines a cutout 34 for receiving the top member 44 of the connecting portion 4 and defines two outer bolting holes 33 communicating with the cutout 34 for inserting the bolts 8 therethrough then into the inner bolting holes 40 of the connecting portion 4. The rotating portion has two protrusions 35 projecting into the cutout 34 of the rotating portion 3 and rotatably engaging with corresponding fixing channels 41 of the connecting portion 4. When assembling, the rotating portion 3 is secured onto the connecting portion 4 by the bolts 8.

Figure 5:
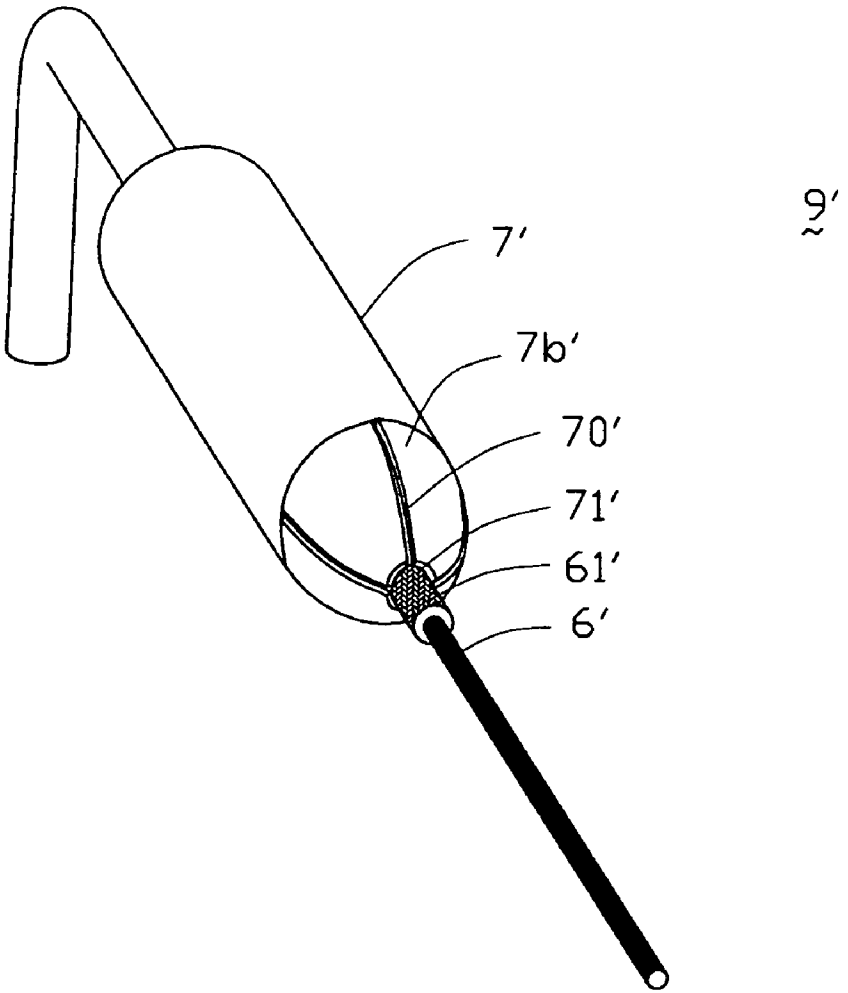
FIG. 5 is a perspective view of the main antenna body of the cable antenna assembly according to a second embodiment of the present invention.

Referring to FIG. 5, the cable antenna element 9' according to a second embodiment of the present invention comprises a grounding sleeve 7'. A plurality of slots 70' are arranged in a half-closed mouth 7*b'* for helping the fixing hole 71' elastically expand to allow the outer conductor 61' of the coaxial cable 6' to be inserted therethrough and then elastically contract back to securely fix the outer conductor 61'. In this embodiment, other portions of the cable antenna assembly 1 have constructions similar to those of the first embodiment; thus, a detailed description thereof is omitted herefrom. Similarly, another alternative embodiment may provide elastic structure only on the fixing hole at the end of the grounding sleeve, e.g., the circumferentially arranged multiple leaf-like curved fingers formed by the notch structures rather than the slot structure.

It is to be understood that the embodiments and variations shown and described herein are merely illustrative of the principles of this invention and that various modifications may be implemented by those skilled in the art without departing from the scope and spirit of the invention. Especially, it is to be understood that the present invention is not in any way restricted to the mentioned forms or assemblies of the illustrated devices.

What is claimed is:

1. A cable antenna assembly comprising:

a connecting portion adapted for connecting with a connector;

a rotating portion being rotatably mounted on the connecting portion; and a cable antenna element comprising a coaxial cable being inserted into the connecting portion through the rotating portion and comprising an inner conductor, an inner insulator, an outer conductor and an outer insulator, and a single grounding sleeve fixed on the coaxial cable, grasping the outer conductor and inserted in to rotating portion, the grounding sleeve defining a fixing hole electrically connecting with to outer conductor of the coaxial cable and a slot therein for permitting elastically expansion of the fixing hole when the coaxial cable is inserted and then elastical contraction for securely fixing the coaxial cable wherein the cable with the grounding sleeve has a movement relative to the rotating portion while the rotating portion rotates.

2. The cable antenna assembly as claimed in claim 1, wherein the rotating portion comprises a protrusion and the connecting portion comprises a plurality of fixing channels, the protrusion rotatably engaging with a corresponding fixing channel.

3. The cable antenna assembly as claimed in claim 1, wherein the rotating portion comprises a front member comprising an inner ring and an outer ring, the grounding sleeve being inserted between the inner ring and the outer ring.

4. The cable antenna assembly as claimed in claim 1, wherein the coaxial cable is inserted through the rotating portion into the connecting portion.

5. A cable antenna element comprising:

a coaxial cable comprising an inner conductor surrounded by sequentially an inner insulator, an outer conductor and an outer insulator; and a single grounding sleeve having a hemispherical surface end, inwardly grasping the outer conductor and surrounding the coaxial cable made of metal material defining a fixing hole on the hemispherical surface end for connecting with the outer conductor of the coaxial cable and a slot for helping the fixing hole to elastically fix on the outer conductor of the cable.

6. The cable antenna element as claimed in claim 5, wherein the grounding sleeve is bottle-shaped.

7. The cable antenna element as claimed in claim 5, wherein the slot extends from the fixing hole.

8. The cable antenna element as claimed in claim 5, wherein the slot is extending from the fixing hole along the direction of the coaxial cable.

9. A cable antenna assembly comprising:

a connecting portion;

a rotating portion being rotatably mounted on the connecting portion; and a cable antenna element comprising a coaxial cable being inserted into the connecting portion through the rotating portion and comprising in sequence an inner conductor, an inner insulator, an outer conductor and an outer insulator, and a grounding sleeve surrounding the coaxial cable, grasping the outer conductor and inserted in the rotating portion, the grounding sleeve defining a fixing hole at a front end electrically connecting with the outer conductor of the coaxial cable and means for permitting elastic expansion of fixing hole when the different sized coaxial cable is inserted and then elastic contraction for securely fixing the coaxial cable wherein the said grounding sleeve directly inwardly presses against the outer conductor where the outer conductor directly intimately contacts and presses against the inner insulator.

10. The cable antenna element as claimed in claim 1, wherein the grounding sleeve having a hemispherical surface end, and the fixing hole is defined on the hemispherical surface end.

11. The cable antenna element as claimed in claim 5, wherein said outer conductor is directly intimately sandwiched radially between the sleeve and the inner insulator.

12. The cable antenna element as claimed in claim 9, wherein only the outer conductor is radially sandwiched between the sleeve and the inner insulator.

13. The cable antenna element as claimed in claim 9, wherein the cable with the grounding sleeve has a movement relative to the rotating portion while the rotating portion rotates.

* * * * *